US005711716A

United States Patent [19]

O'Brien et al.

[11] Patent Number: 5,711,716

[45] Date of Patent: Jan. 27, 1998

[54] GOLF PUTTING TRAINING DEVICE

[76] Inventors: J. Andrew O'Brien, 6635 Banner Lake Cir., Apt. 4106, Orlando, Fla. 32821; John A. De Dominicis, 11428 Willow Stowe La., Windermere, Fla. 34786

[21] Appl. No.: 753,253

[22] Filed: Nov. 21, 1996

[51] Int. Cl.[6] ..... A63B 69/36

[52] U.S. Cl. ..... 473/212; 473/201

[58] Field of Search ..... 473/212, 276, 473/213, 214

[56] References Cited

U.S. PATENT DOCUMENTS

| | | | |
|---|---|---|---|
| 3,658,344 | 4/1972 | Kimble | 473/273 X |
| 5,040,798 | 8/1991 | Leitao . | |
| 5,085,437 | 2/1992 | Leitao . | |
| 5,096,199 | 3/1992 | Wyatt et al. | 473/212 |
| 5,145,179 | 9/1992 | Breed . | |
| 5,248,146 | 9/1993 | Viets et al. . | |
| 5,259,621 | 11/1993 | Keefer . | |
| 5,470,073 | 11/1995 | Vasquez . | |

OTHER PUBLICATIONS

"Wrists of the world, unite and putt?", *Golf Digest*, Nov., 1974, p. 68.

*Primary Examiner*—George J. Marlo

*Attorney, Agent, or Firm*—Sixbey, Friedman, Leedom & Ferguson; Stuart J. Friedman

[57] ABSTRACT

A golf putting training device for a golfer comprising an elongate rigid support member, a pair of arm-embracing members for receiving therethrough and partially encircling the golfer's forearms, each arm-embracing member mounted on the support member for longitudinal movement relative to the other arm-embracing member and for independent pivotal movement relative to the bar about a pivot axis extending substantially perpendicularly of the longitudinal extent of the bar. The arm-embracing members each comprise a tapered, tubularly formed sleeve having a larger diameter at one end of the sleeve for fitting snugly over the golfer's upper forearm adjacent the crook of the elbow and a smaller diameter at the opposite end of the sleeve for fitting snugly over the golfer's lower forearm adjacent the wrist. The sleeves are mounted on the bar by threaded bolts which pass through the sleeves and an elongate, generally longitudinally arranged slot formed in the bar and are held thereon by manually adjustable wing nuts on each threaded bolt. The wing nuts may be hand loosened and tightened to permit longitudinal sliding of each bolt in the slot for adjusting the longitudinal spacing between the sleeves and pivotal movement of each sleeve about the bolt passing therethrough as a pivot axis for adjusting the angular position of the sleeve.

14 Claims, 3 Drawing Sheets

GOLF PUTTING TRAINING DEVICE

BACKGROUND OF THE INVENTION

1. Field of the Invention

The present invention relates to golf instructional or training devices and, more particularly, to golf training devices intended to improve putting.

2. Description of the Prior Art

Putting is one of the most fundamental and important aspects in the game of golf. Par for an eighteen hole golf course is typically about 72 and is determined by allocating two putting strokes per hole. Thus, it is fair to say that approximately half of the strokes in a par round of golf are putting strokes. It is, of course, true that most rounds of golf are not par rounds. However, even the duffer who shoots a score of 100 for eighteen holes typically uses 35–40 or more putting strokes per round.

It is, therefore, beyond doubt that putting skill impacts considerably on a golfer's score and improving one's putting skill is an objective of virtually every serious golfer. It is generally recognized that to improve putting proficiency a golfer must adopt and learn a consistent and reproducible putting stroke. It is also generally recognized that the most effective putting stroke is a pendulum-like motion in which the golfer's arms move together, the pendulum-like motion originating in the golfer's shoulders. Generally, the larger shoulder muscles of the upper body are much more controllable than the smaller arm muscles and, therefore, provide better control of the putting stroke. Accordingly, effective putting training devices attempt to encourage a putting motion which permits the larger muscles of the golfer, i.e., the forearms, upper arms and shoulders, to control the stroke.

Many golfers who have inadequate putting strokes encounter difficulty in correctly positioning and aligning their forearms, elbows and shoulders to permit a proper pendulum stroke. Rather, they permit their lower arms and wrists to influence the stroke. Invariably this results in motion of the wrists relative to the arms, i.e., flipping of the wrists or rolling of the hands, in the back or forward strokes, or a breakdown of one or the other wrists. Any substantial deviation from the ideal pendulum stroke is likely to produce an inconsistent, non-reproducible putting stroke and inconsistent results.

There have been numerous putting training devices proposed in order to address the putting problems of most golfers and to assist golfers to practice effective putting techniques in order to improve their putting stroke. Several of these aids are intended, in use, to be affixed to the putter as well as to the golfer's arms. For example, U.S. Pat. No. 5,248,146—Viets et al discloses a putting trainer having a pair of inverted U-channels extending angularly from each end of a bar or plate and adjustable elastic bands disposed about each channel for holding the trainer on the golfer's arms. The plate is attached to the top end of the putter. However, the angles between the plate and the U-channels appear to be fixed and non-adjustable as is the length of the plate and thus the distance between the golfer's arms. As a result, the Viets et al training device constrains the golfer's normal grip, posture and feel to the unalterable dimensional limitations of the device and thus would likely have to be custom made to accommodate the size, shape and grip preferences of each golfer. Other putting aids, such as the one disclosed in U.S. Pat. No. 5,470,073—Vasquez are designed to be held against and parallel to the grip of the putter while employing arm bands mounted on adjustable links to position the golfer's arms relative to the putter. Still other putting aids attach only to the golfer's arms in an effort to improve the alignment of the forearms, elbows and shoulders and to aid in the development of a one-piece movement during the putting stroke. For example, U.S. Pat. No. 5,085,437—Laitao discloses a chipping and putting practice device comprising a rigid elongated shaft and two flexible, elastic arm attachment loops for attachment to the golfer's arms. The spacing between the loops may be adjusted by repositioning the loops on the bar or by using a telescoping bar. However, the use of flexible elastic loops provides neither rigidity nor support for the golfer's arms and, therefore, mandates no unalterable directional positioning of the angle of the lower forearms, wrists and hands with respect to the putter. As a result, the Laitao device neither forces proper positioning of the club relative to the lower arm portions of the golfer nor impedes flipping or rolling of the wrists.

There is no shortage of golf training devices which try in various ways to teach or physically assist in achieving proper putting form for improving the putting stroke. Whatever the specific approach, the overall objective of a golf putting training device must be to develop a muscle memory from continued use of the training device. Only in this way will a reproducible and consistent putting stroke be developed which the golfer will utilize even without the aid of the training device. None of the prior art devices are able to achieve, via a simple inexpensive and easy to use putting aid, an effective pendulum-like putting stroke which is controlled by the large muscles of the golfer's shoulders, upper arms and forearms while minimizing the deleterious effects of the wrists and smaller arm muscles on the stroke. Accordingly, a need exists for a putting training aid which develops muscle memory for a reproducible and consistent putting stroke and which is both useful and affordable by all golfers, irrespective of size, shape and financial means.

SUMMARY OF THE INVENTION

It is, therefore, an object of the present invention to provide a golf putting training device which instills a proper, comprehensive and reproducible muscle memory of the alignment of the forearms, upper arms and shoulders and the mechanical components of the putting stroke.

It is another object of the present invention to provide a golf putting training device which is capable of both angular and longitudinal adjustments to accommodate golfers of various sizes and shapes and all manner of putting stances.

It is still another object of the present invention to provide a golf putting training device which is economical to manufacture and, therefore, can be made available to the golfing public at a readily affordable price.

It is yet another object of the present invention to provide a golf putting training device which is easy and comfortable to use.

These objects and others are achieved by providing a golf putting training device comprising an elongate rigid support member, a pair of arm-embracing members for receiving the golfer's forearms therethrough, each of the arm-embracing member mounted on the support member for longitudinal movement relative to the other arm-embracing member along the bar and for independent pivotal movement relative to the bar about a pivot axis extending substantially perpendicularly of the longitudinal extent of the bar, the arm-embracing members each including means for supporting the golfer's forearms along substantially the entire length thereof between the golfer's wrists and the crook of the golfer's elbow, whereby the longitudinal spacing between and angular position of the arm-embracing members can be adjusted to accommodate the size, shape and putting stance of the golfer in order that the training device will comfortably and correctly position the golfer's arms to encourage a pendulum-like putting motion which permits the larger muscles of the golfer to control the putting stroke and discourages the tendency to allow the wrists to adversely influence the putting stroke.

In a preferred aspect of the invention each arm-embracing member comprises an elongate, resilient sleeve having a longitudinally extending gap therein for partially encircling the forearm of the golfer. Desirably the sleeve comprises a tapered tubularly formed member having a larger diameter at one end of the sleeve for fitting snugly over the golfer's upper forearm adjacent the crook of the elbow and a smaller diameter at the opposite end of the sleeve for fitting snugly over the golfer's lower forearm adjacent the wrist.

In still another preferred aspect of the invention the bar includes an elongate, generally longitudinally arranged slot formed therein, pivot means slidable in the slot and defining a pivot axis extending substantially perpendicularly of the longitudinal extent of the bar, each arm-embracing member mounted to the pivot means for longitudinal movement along the slot relative to the other arm-embracing member and for independent pivotal movement relative to the bar about the pivot axis. Desirably, the pivot means includes two threaded bolts, each bolt passing through one of the arm-embracing members and the slot, and manually adjustable nut means received on each threaded bolt, whereby the nut means may be hand loosened and tightened to permit longitudinal sliding of each the bolt in the slot for adjusting the longitudinal spacing between the arm-embracing members and pivotal movement of each arm-embracing member about the bolt passing therethrough as a pivot axis for adjusting the angular position of the arm-embracing member.

DESCRIPTION OF THE PREFERRED EMBODIMENT

Figure 1:
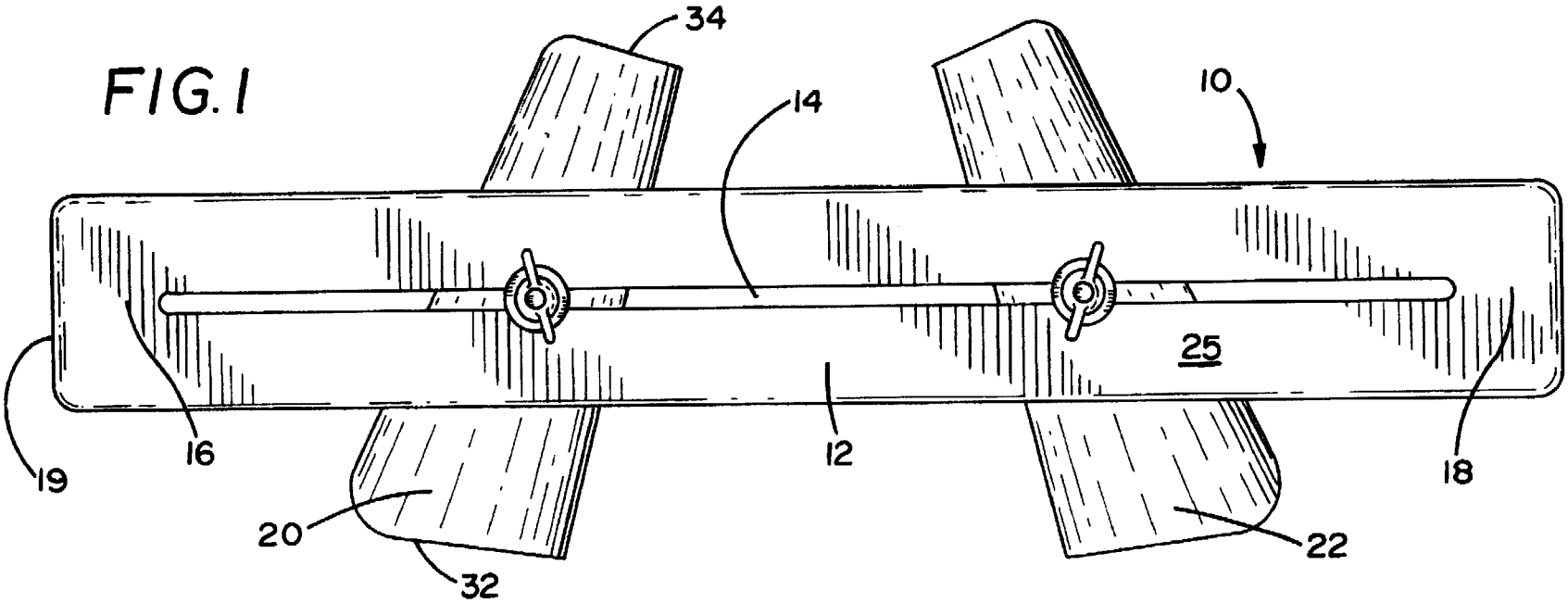
FIG. 1 is a plan view of the golf putting training device of the present invention.
Figure 2:
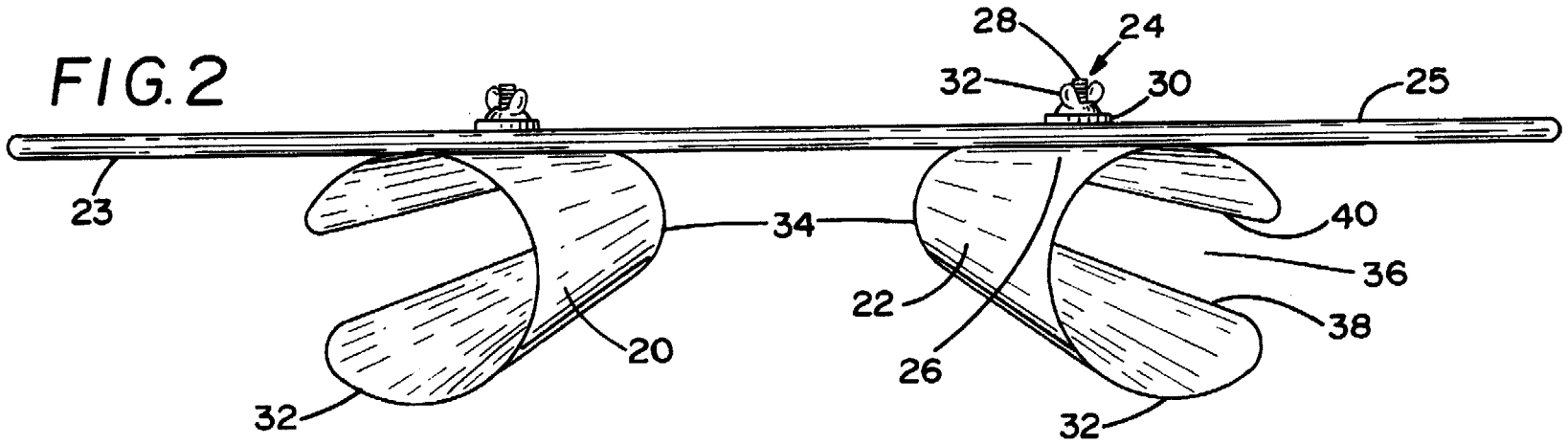
FIG. 2 is a front elevational view of the golf putting training device of the present invention.
Figure 3:
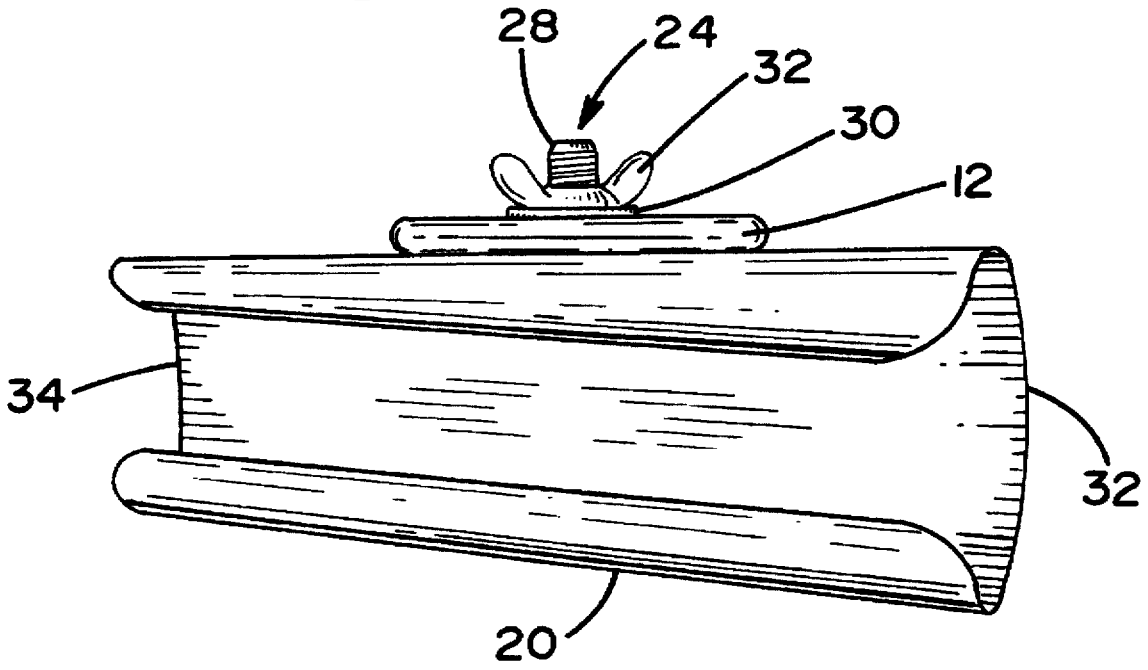
FIG. 3 is a side elevational view of the golf putting training device of the present invention.

Referring now to the drawings and particularly to FIGS. 1 through 3, the golf putting training device of the present invention is indicated generally at 10. Golf putting training device 10 comprises a rigid, elongated bar 12 constructed of lightweight material, such as wood, plastic and lightweight metal. An elongate slot 14 is formed in bar 12 extending generally along the longitudinal centerline of the bar from one end portion 16 to the other end portion 18 of bar 12. A pair of arm embracing members, in the nature of sleeves or cuffs, 20, 22, are supportably mounted on the same face 23 of bar 12 via threaded bolts 24 which include a head portion (not shown) positioned within and abutting the wall 26 of each sleeve adjacent bar 12 and a threaded shank portion 28 extending through sleeve wall 26 and elongate slot 14. A washer 30 and finger adjustable wing nut 32 threaded onto the threaded end of each bolt 24 on the face 25 of the bar opposite the face 23 on which the sleeves 20, 22 are mounted permits tightening and loosening of the sleeves on the bar in order that they may be slidably positioned on the bar and comfortably spaced from each other by relative movement of the sleeves along the slot. Pivotally mounting the sleeves 20, 22 on the bar 12 in this manner permits relative angular movement of the sleeves about the bolt shank 28 which acts as a pivot axis extending substantially perpendicularly of the longitudinal extent of the bar.

Sleeves 20, 22 are contoured to fit snugly over the inside of the right and left forearms of the golfer extending generally from the wrists to just below the crook of the elbow for supporting the golfer's forearms along substantially the entire length thereof. Each sleeve 20, 22 comprises a tapered, tubularly formed resilient member which is adapted to partially encircle the forearm of the golfer. As can best be seen in FIGS. 2 and 3 each sleeve 20, 22 is desirably formed as a truncated hollow cone having a larger diameter at one end 32 of the sleeve intended to fit snugly over the golfer's upper forearm adjacent the crook of the elbow and a smaller diameter at the opposite end 34 of the sleeve intended to fit snugly over the golfer's lower forearm adjacent the wrist. As can be seen in FIG. 1, the sleeves 20, 22 are both positioned on the same face 23 of the bar 12 and are oriented generally transversely of the longitudinal extent of the bar 12 with both larger diameter ends of the sleeves on the same side of the longitudinal extent of the bar so that the golfer can slide his/her arms into the larger diameter end of the sleeves until the sleeve wall is positioned comfortably between the wrist and the crook of the elbow in contact with the inside portion of the forearm, as shown most clearly in FIG. 4. With the sleeves contacting the golfer's forearms in the position described and with the golfer in his/her putting stance addressing the ball, the bar 12 lays across the inside portion along the top of the forearms and, during the putting stroke, its leading edge 19 points along the intended line of the putt.

The sleeves 20, 22 are desirably formed of a material which is lightweight and relatively rigid in order to provide support and directional guidance for the golfer's forearms when inserted therein, yet which can be formed into an unclosed cuff in which shape it is circumferentially resilient in order to expand for fitting snugly over the forearms of the golfer and to return to its original dimensions when removed from the golfer's forearms. For this purpose various plastic materials are preferred although other materials having the desired properties can be used as well. It will be appreciated that the purpose of using a circumferentially resilient, generally conical tubular sleeve having a substantial length dimension extending between the golfer's wrist and the crook of the elbow is to provide a substantially rigid directional support for the golfer along the entire length of the forearm. By using an unclosed cuff, the circumferential resilience of the sleeve will cause it to approximately conform to the forearm dimensions of the golfer, providing a snug but comfortable fit. In this way a single size sleeve can be dimensioned to fit the overwhelming majority of golfers, male and female. One exemplary sleeve which has been found to be suitable for this purpose has a length of about seven inches, a small diameter end having a diameter of about 2–2.5 inches, a large diameter end having a diameter of about 2.75–3.25 inches and a circumferential extent of about 270° to 290° . Depending upon the circumferential extent of the sleeve and the size of the golfer's forearms, the golfer may be able to slip his/her arm into the sleeve through the gap 36 defined between the facing sleeve wall edges 38, 40. If desired, the hollow conical sleeve member may be bent outwardly at its extremities (not shown) so as to more easily slip onto the forearm and bent outwardly at its smaller and larger diameter end edges (not shown) so as to avoid catching on the golfer's clothing.

Figure 4:
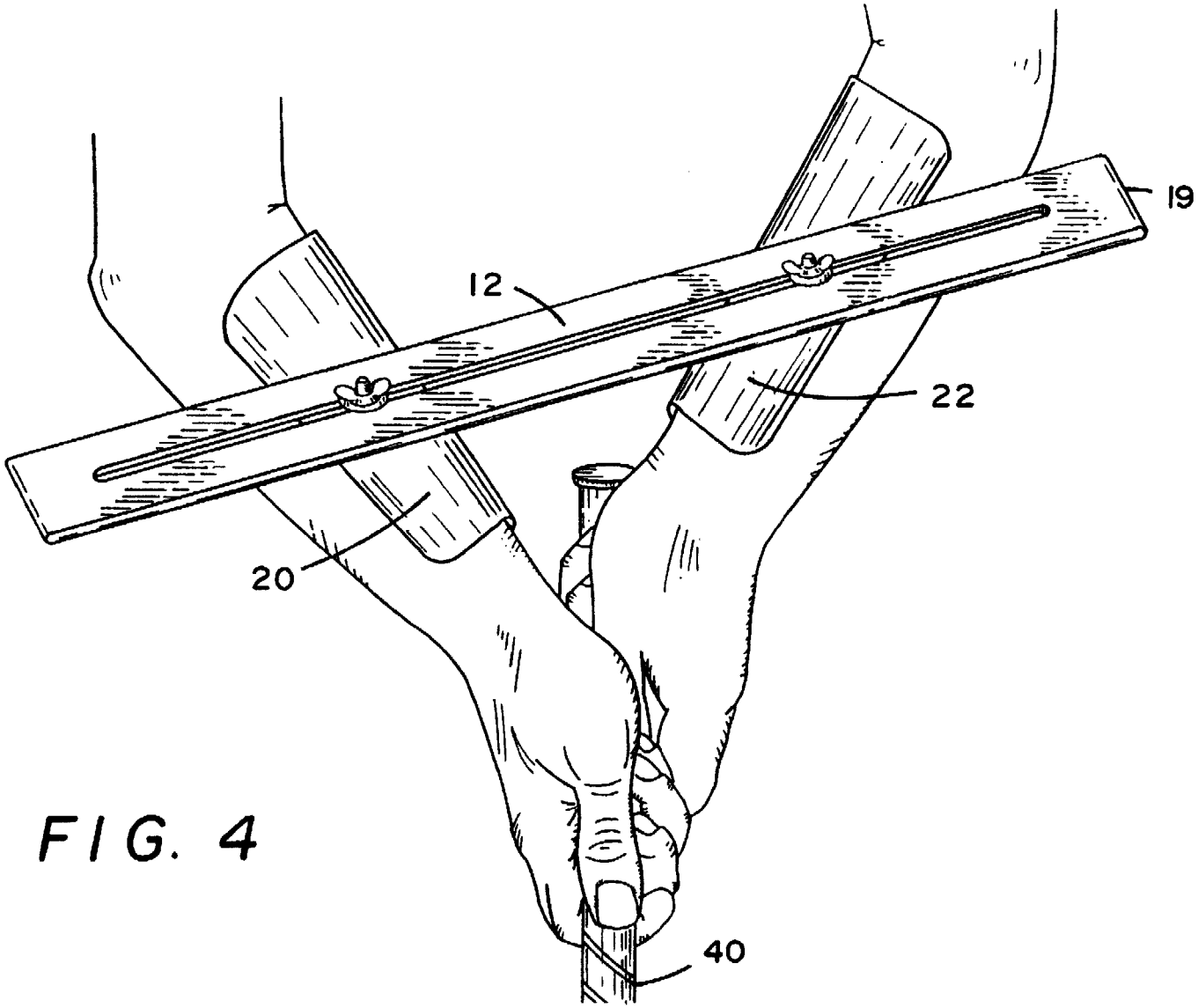
FIG. 4 is a perspective view of a golfer's hands and arms holding a putter with the golf putting training device of the present invention in place on the golfer's forearms.

Referring to FIG. 4, the golfer can customize the golf putting training device of the present invention for his/her particular size, shape and putting stance by adjusting the longitudinal position or separation of the sleeves 20, 22 along elongate slot 14 and their individual angular positions relative to bar 12. This can be most easily accomplished by loosening wing nuts 32 an amount sufficient to permit the sleeves to slide along bolt shanks 28 in elongate slot 14 and to rotate about bolt shanks 28. Thereafter, in one manner of using the training device of the present invention, the golfer inserts his/her forearms into the larger diameter ends 32 of sleeves 20, 22 of the golf putting training device 10 of the present invention, with the bar 12 on the side of the golfer's arms remote from the golfer's body, and grips the putter 40 with his/her hands. In so doing, the bolt shanks 28 and attached sleeves 20, 22 slide through the slot 14 until a comfortable elbow-to-elbow spacing is achieved. At the same time the sleeves rotate about bolt shanks 28 as the pivot axis to accommodate the golfer's size and shape and his/her normal putting stance over the ball. Once comfortable longitudinal and angular positions for the sleeves are found, the wing nuts are tightened to maintain these relative positions. It can be seen that sleeves 20, 22 comfortably contact the inside of the golfer's forearms between the wrist and the crook of the elbow. At the same time bar 12 is positioned with the leading edge 19 pointing in the intended direction of the putt.

The present invention provides a golf putting training device which improves the putting stroke of the golfer by positioning the golfer's arms in a comfortable and correct position and preventing the natural tendency during the putting stroke to roll or rotate the forearms and/or break the wrists. This is accomplished by correctly positioning the golfer's forearms in spaced relation and thereafter stabilizing the position of the forearms relative to one another during the putting stroke. The spacing bar 12 and sleeves 20, 22 are specifically adapted for securely engaging and positioning the forearms of the golfer in spaced relation, and may be adjusted to the varying spacial and angular alignments of the golfer's size, shape and putting stance to promote a pendulum putting stroke controlled by the large muscles of the forearms, upper arms and shoulders. After using the golf putting training device of the present invention for a period of time the golfer becomes accustomed to the feel of the proper pendulum putting stroke. When putting without the training device, muscle memory will cause the golfer to continue to utilize the proper putting stroke which has been learned as a result of practice with the training device.

We claim:

1. A golf putting training device for a golfer comprising:

an elongate rigid support member;

a pair of forearm-embracing members for receiving the golfer's forearms therethrough, said forearm-embracing members dimensioned for snugly embracing the golfer's forearms and each including means for supporting the golfer's forearms along substantially the entire length thereof between the golfer's wrists and the crook of the golfer's elbow;

each said forearm-embracing member mounted on said support member for longitudinal movement relative to said other forearm-embracing member along said support member and for independent pivotal movement relative to said support member about a pivot axis extending substantially perpendicularly of the longitudinal extent of said support member;

whereby the longitudinal spacing between and angular position of said forearm-embracing members can be adjusted to accommodate the size, shape and putting stance of the golfer in order that said training device will comfortably and correctly position the golfer's arms to encourage a pendulum-like putting motion which permits the larger muscles of the golfer to control the putting stroke and discourages the tendency to allow the wrists to adversely influence the putting stroke.

2. A golf putting training device, as claimed in claim 1, wherein each said forearm-embracing member comprises an elongate sleeve having a longitudinally extending gap therein for partially encircling the forearm of said golfer.

3. A golf putting training device, as claimed in claim 2, wherein said sleeve is circumferentially resilient for expanding to accommodate the forearms of the golfer and returning to its original dimension when the golfer's forearms are removed, whereby said sleeve is able to fit snugly over the forearm of the golfer.

4. A golf putting training device, as claimed in claim 3, wherein said sleeve comprises a tapered, tubularly formed member having a larger diameter at one end of the sleeve dimensioned for fitting snugly over and embracing the golfer's upper forearm adjacent the crook of the elbow and a smaller diameter at the opposite end of the sleeve dimensioned for fitting snugly over and embracing the golfer's lower forearm adjacent the wrist.

5. A golf putting training device, as claimed in claim 4, wherein said sleeve is formed as a truncated hollow cone.

6. A golf putting training device, as claimed in claim 1, wherein said support member includes at least one elongate, generally longitudinally arranged slot formed therein, pivot means slidable in said slot and defining a pivot axis extending substantially perpendicularly of the longitudinal extent of said support member, each said forearm-embracing member mounted to said pivot means for longitudinal movement relative to said other forearm-embracing member and for independent pivotal movement relative to said support member about said pivot axis.

7. A golf putting training device, as claimed in claim 6, including at least one threaded bolt passing through one of said forearm-embracing members and said slot and manually adjustable nut means received on said threaded bolt, whereby said nut may be hand loosened and tightened to permit longitudinal sliding of said bolt in said slot for adjusting the longitudinal spacing between said forearm-embracing members and pivotal movement of said forearm-embracing member about said bolt as a pivot axis for adjusting the angular position of said forearm-embracing member.

8. A golf putting training device, as claimed in claim 7, including two threaded bolts, each bolt passing through one of said forearm-embracing members and said slot, and manually adjustable nut means received on each said threaded bolt, whereby said nut may be hand loosened and tightened to permit longitudinal sliding of each said bolt in said slot for adjusting the longitudinal spacing between said forearm-embracing members and pivotal movement of each said forearm-embracing member about the bolt passing therethrough as a pivot axis for adjusting the angular position of said forearm-embracing member.

9. A golf putting training device, as claimed in claim 8, wherein said manually adjustable nut means comprises finger adjustable wing nuts.

10. A golf putting training device, as claimed in claim 8, wherein each said forearm-embracing member comprises an elongate sleeve having a longitudinally extending gap therein for partially encircling the forearm of said golfer.

11. A golf putting training device, as claimed in claim 10, wherein said sleeve is circumferentially resilient for expanding to accommodate the forearms of the golfer and returning to its original dimension when the golfer's forearms are removed, whereby said sleeve is able to fit snugly over the forearm of the golfer.

12. A golf putting training device, as claimed in claim 11, wherein said sleeve comprises a tapered, tubularly formed member having a larger diameter at one end of the sleeve dimensioned for fitting snugly over and embracing the golfer's upper forearm adjacent the crook of the elbow and a smaller diameter at the opposite end of the sleeve dimensioned for fitting snugly over and embracing the golfer's lower forearm adjacent the wrist.

13. A golf putting training device, as claimed in claim 12, wherein said sleeve is formed as a truncated hollow cone.

14. A golf putting training device, as claimed in claim 12 wherein said support member includes a first face and an opposite face, said sleeves are mounted on said first face by said bolts passing through the wall of each sleeve adjacent said support member and through said slot, said manually adjustable nut means being received on said threaded bolts adjacent the opposite face, said sleeves being oriented generally transversely of the longitudinal extent of said support member with the larger diameter ends of said sleeves on the same side of the longitudinal extent of said support member, whereby said sleeves contact the inside portion of the golfer's forearms and said support member extends across the inside portion along the top of the golfer's forearms when the golfer assumes a putting stance.

* * * * *